US005498168A

United States Patent [19]

Wedin et al.

[11] Patent Number: 5,498,168

[45] Date of Patent: Mar. 12, 1996

[54] EARTHING MECHANICS FOR SHIELDED CABLES

[75] Inventors: Annette G. Wedin, Huddinge; Lars-Erik Hallenfur, Älvsjö ; Lars Y. Bertilsson, Stockholm; Jan-Erik Karlsson, Farsta, all of Sweden

[73] Assignee: Telefonaktiebolaget LM Ericsson, Stockholm, Sweden

[21] Appl. No.: 245,636

[22] Filed: May 18, 1994

[30] Foreign Application Priority Data

May 19, 1993 [SE] Sweden ..... 9301737

[51] Int. Cl.[6] ..... H01R 21/20

[52] U.S. Cl. ..... 439/95; 439/817; 439/772

[58] Field of Search ..... 439/607–610, 439/578–585, 840, 92, 95, 98, 99, 108, 817, 772, 774

[56] References Cited

U.S. PATENT DOCUMENTS

| | | | |
|---|---|---|---|
| 2,937,227 | 5/1960 | Selnau | 439/92 |
| 2,938,692 | 5/1960 | Bosworth et al. . | |
| 4,536,045 | 8/1985 | Reichard et al. | 439/95 |
| 4,767,345 | 8/1988 | Gutter et al. | 439/92 |
| 5,261,826 | 11/1993 | Leeb et al. . | |
| 5,273,459 | 12/1993 | Davis | 439/607 |
| 5,338,227 | 8/1994 | Nakamura | 439/607 |

FOREIGN PATENT DOCUMENTS

| | | |
|---|---|---|
| 695125 | 7/1940 | Germany . |
| 3112554A1 | 10/1982 | Germany . |
| 3831840C2 | 3/1990 | Germany . |

*Primary Examiner*—David L. Pirlot
*Attorney, Agent, or Firm*—Burns, Doane, Swecker & Mathis

[57] ABSTRACT

A device for earthing a bundle of shielded cables as protection against high frequency electromagnetic interference includes a rectangular metal collar in electrically conductive contact with the equipment to which or from which the shielded cables run. The cable shields are exposed and pressed into contact with an electrically conductive base plate in electrical contact with the collar, which includes pair-forming openings in each of two mutually opposing sides. The base plate is provided with pairs of outwardly projecting fingers intended for insertion into some of the pair-forming openings. A spring unit, including a pressure plate, a spring, a locking plate provided with pairs of outwardly projecting fingers, a counter-pressure plate, and a holder device, is intended to be inserted in pair-forming openings at a distance from the base plate via the fingers on the locking plate. Before installing the cables, the spring is mounted in a substantially compressed state between the pressure plate and the counter-pressure plate with the aid of the holder device. After installation, the holder device is loosened so the spring extends and applies a constant pressure to the cables installed between the base plate and the locking plate.

5 Claims, 2 Drawing Sheets

EARTHING MECHANICS FOR SHIELDED CABLES

BACKGROUND

The present invention relates to an earthing device for grounding a bundle of shielded cables as protection against high frequency electromagnetic interferences, comprising a rectangular metal collar which is in electrically conductive contact with the equipment to which or from which the shielded cables run, wherein the cable shields are exposed and are pressured into contact with an electrically conductive base plate in contact with the collar.

Earthing devices for single cables and cable bundles are known to the art. These devices normally include a clamping joint in the form of a plate which in conjunction with a screw or like device presses the cable or cable bundle against a supportive surface which is in electrically conductive contact with the equipment to be earthed or grounded. A typical method of pressing the cable or cable bundle against the supportive surface uses an eccentric device which is maneuvered with the aid of a lever or some like means. One drawback with these devices is that the force with which the cable or cable bundle is pressed against the supportive surface is difficult to control, meaning that either the earth contact is unsatisfactory or that the cables are squashed to pieces and destroyed. An earthing contact which is poor from the beginning will be made even worse should the cable or cables move in the passage of time.

Another known earthing device comprises a metal stocking which is attached between a frame and the housing in which the equipment to be earthed is housed. The exposed shielded cables are passed through the stocking and the cables are pressed against an outwardly bent part of the frame by means of a device which includes a bundle strap, a yoke and two pressure springs. Although this device ensures that a satisfactory earth contact is obtained, the device is complicated and installation of the cables is time-consuming, as is also any changes that need to be made to the cables or the addition of further cables.

SUMMARY

The object of the present invention is to eliminate the drawbacks of existing earthing devices, by providing an earthing device which is simple and reliable in operation, which is simple to handle both when installing cables and when adding or replacing cables.

The inventive earthing device is intended to earth shielded cables as a protection against high frequency electromagnetic disturbances. The earthing principle used is one in which the cable shields are exposed, i.e. the outer casing is stripped, and the cables are brought into contact with an electrically conductive plate by spring pressure, this plate being in contact with the equipment to which or from which the shielded cables run. Should the cable or the cable bundle move in the passage of time, the spring will continue to press against the cables with an unchanged pressure force, thereby ensuring that the earthing contact is maintained.

The invention will now be described in more detail with reference to a preferred exemplifying embodiment thereof and also with reference to the accompanying drawings.

DETAILED DESCRIPTION

Figure 1:
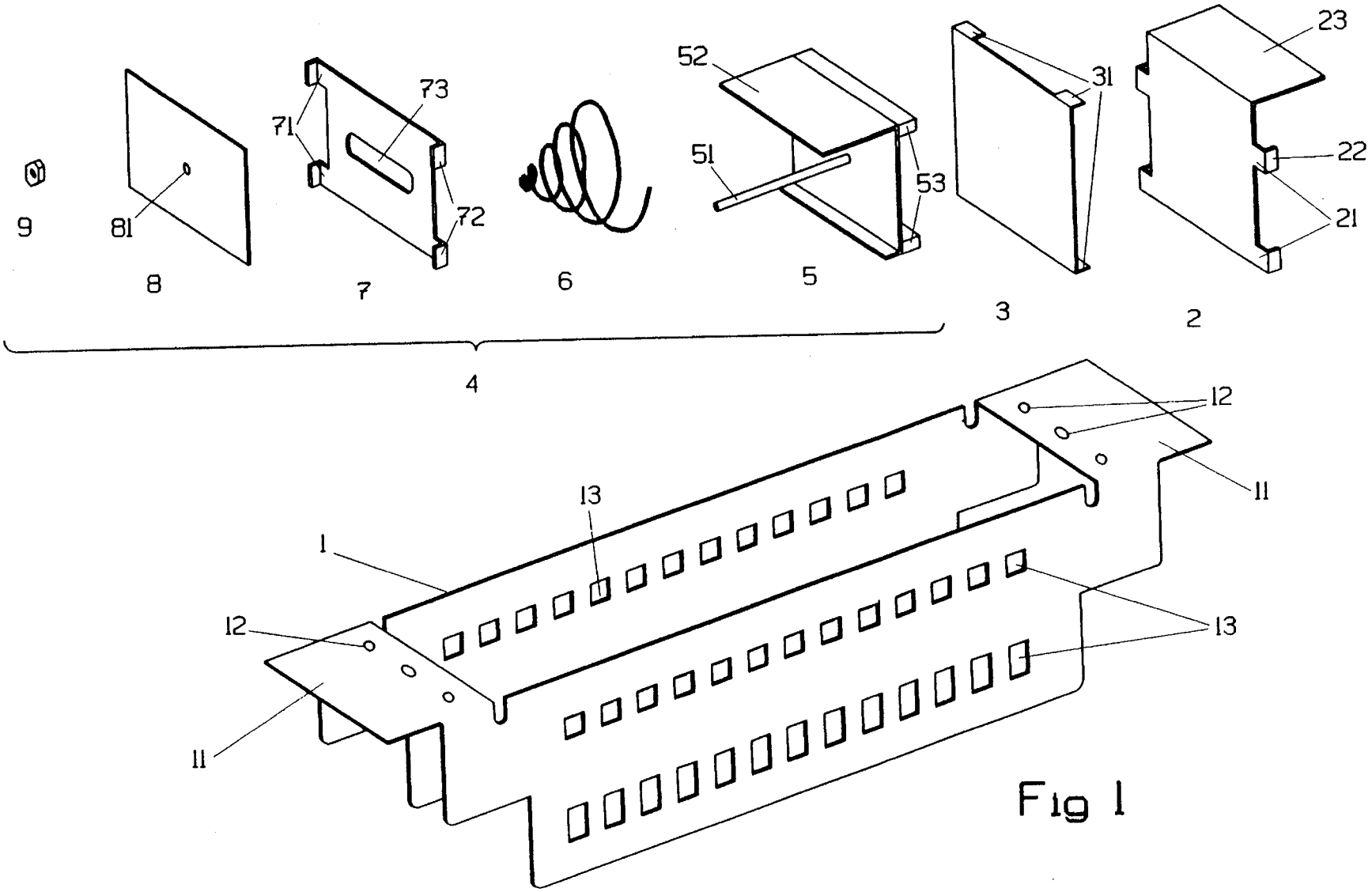
FIG. 1 is a perspective illustration of the components of an inventive device.
Figure 2:
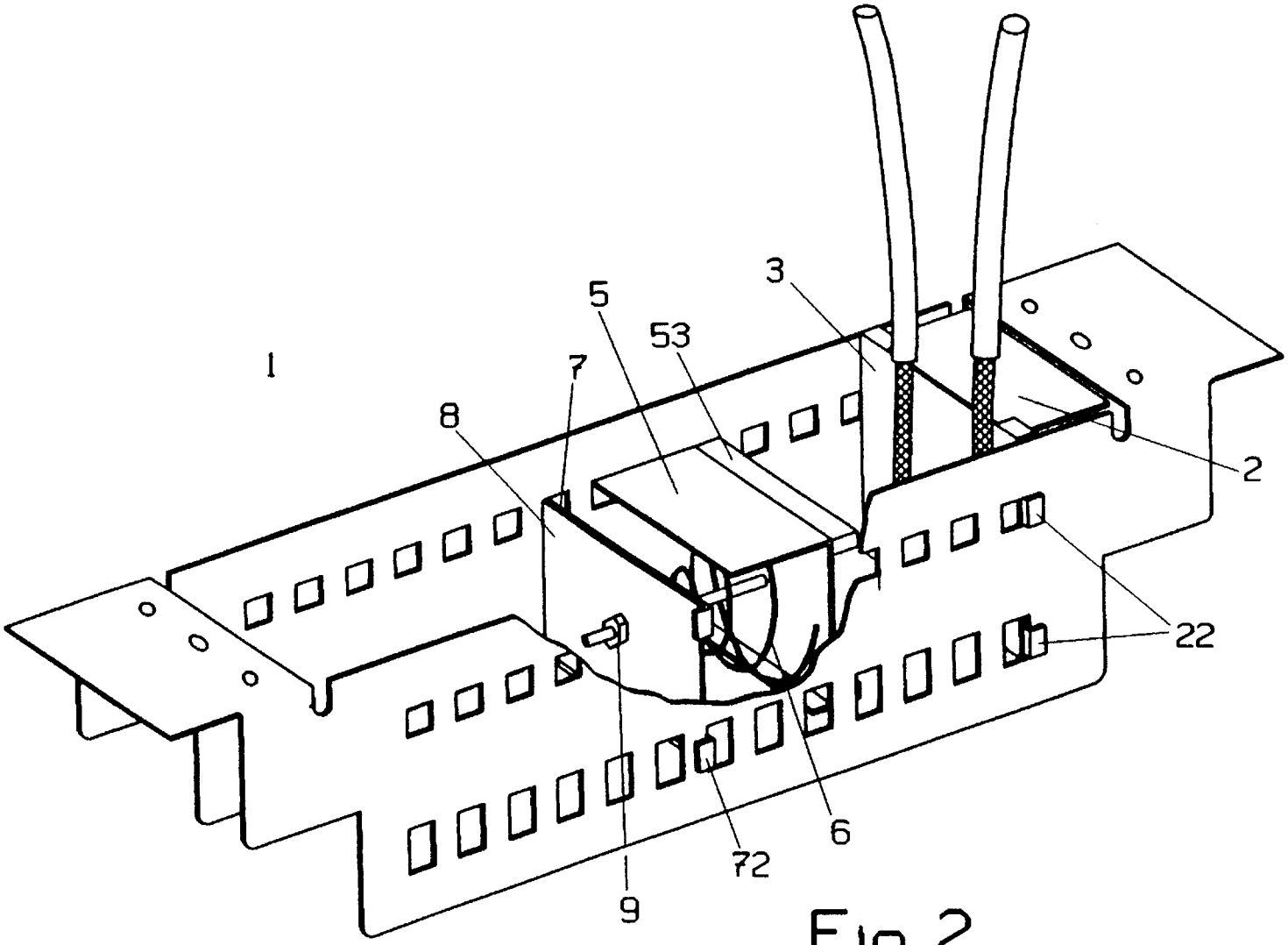
FIG. 2 is a perspective illustration of the assembled device, with a cable bundle inserted therein.

FIG. 1 illustrates in perspective the individual components of the inventive earthing device, and FIG. 2 illustrates the device when assembled. The device includes a metal rectangular collar 1 which is intended to be secured to the equipment to be earthed in some suitable manner. The collar is provided to this end with attachment flanges 11 and attachment holes 12, although it will be understood that the illustrated flanges and holes are simply examples and can be configured in a number of other ways. The collar 1 functions as a rigid mechanical carrier for the remaining components or parts of the device. The collar 1 is provided on the two mutually opposing long sides thereof with pair-forming openings 13 for the attachment of a base plate 2 and a locking plate 7.

The base plate 2 is made of a rigid conductive material and is provided with fingers 21 which project out in pairs and which are intended for insertion into some of the openings 13, suitably the outermost openings, and function to lock the base plate in position and also to provide electrical contact with the collar. In order to prevent the sides of the collar 1 from flexing outwards when the collar is filled with cable, the outermost parts 22 of the fingers 21 are bent at right angles so as to grip the outer sides of the collar 1. The base plate 2 is also provided conveniently with a part 23 which is bent to a right angle so as to cover the space between the base plate and the adjacent attachment flange 11 of the collar. In order to enable the base plate 2 to be secured in the collar 1, it is necessary that the width of the plate is smaller than the distance between the long sides of the collar 1. It is possible that the cables could be pressed out and squashed to pieces in the space thus formed between the fingers 21 and the base plate 2 and the inner sides of the collar 1 in the assembled state of the device, and to prevent this the device includes a thin cover plate 3 which fits onto the base plate 2 so as to cover this space. The cover plate 3 is fitted to the base plate 2 with the aid of right-angled parts or tabs 31 which grip around the upper and lower edges of the base plate.

A spring unit 4 comprised of a pressure plate 5, a spring 6, the aforesaid locking plate 7, a counter-pressure plate 8 and a holder device 9 is intended to be mounted in the collar 1 at a distance from the base plate 2. The pressure plate 5 is made of a rigid, conductive material and is provided with a central, screw-threaded rod 51 and is also suitably provided with a right-angled part 52 which covers the space between the pressure plate and the locking plate 7. Mounted on the pressure plate 5 are contact strips 53 which are made of soft conductive material and which function to prevent the cables squeezing past the spring unit 4 and also to prevent the cables located nearest the spring unit 4 from being squashed to pieces. The spring 6 is a coil spring which is so dimensioned as to contribute in the construction to maintaining the cables stretched under constant pressure without squashing the cables or short-circuiting the same. Similar to the base plate 2, the locking plate 7 is provided with pairs of outwardly projecting fingers 71, the outermost part 72 of which are folded to form right angles so as to grip the outer surfaces of the collar 1, for the same reason as the parts 22. The fingers 71 on the locking plate 7 are inserted into some of the openings 13 in the collar 1, at a suitable distance from the base plate 2, this distance being contingent on the size of the cable bundle to be earthed. The locking plate 7 is also provided with a central, elongated opening 73 for receiving the screw-threaded rod 51 of the pressure plate 5. The counter-pressure plate 8 is provided with a central opening 81 and functions solely to hold the coil spring 6 tensioned in its bottom position while assembling the device. The holder device 9 has the form of a nut which screws onto the screw-threaded rod 51.

Prior to installation, the coil spring 6 is fitted between the pressure plate 5 and the locking plate 7 in a substantially compressed state. When fitting the spring, the locking plate 7 is held clamped in a fixed position, by means of the fingers 71. Subsequent to installing the spring unit 4 and the cable bundle, the holder device 9 is loosened and the spring 6 extends and applies a constant pressure on the cables mounted in the device. This is illustrated schematically in FIG. 2, in which only two cables are shown for the sake of illustration. Should the cables move during the passage of time, the coil spring will continue to extend and thereby exert unchanged pressure on the cables through the medium of the pressure plate 5.

All of the components of the device, with the exception of contact strips, screws, nuts and the coil spring, are surface-treated in a manner to achieve the best possible electrical contact between mechanics and cable shields. The construction requires no after-treatment or maintenance. If the collar is not completely filled with cable, the remaining empty space is covered with a metallic cover plate or some other conductive material.

The earthing device is utilized in the following manner. After having placed the collar 1 in position on the base plate 2, the shielded cables are stripped of their outer casings or sheaths so that the cable shields can be seen, whereafter the cables are placed in layer upon layer on the base plate. If the cable dimensions differ to a great extent, the more slender cables can be bundled into larger cable bundles and secured with the aid of conductive tape. The compressed spring unit 4 is pressed against the cables and locked with the aid of the locking plate 7, whereafter the holder device 9 is loosened and removed, so that the coil spring 6 extends. The space in the collar that is not filled with cable is either covered with a cover or filled with conductive material. When wishing to install more cables in the device, the cover is removed and the spring 6 is compressed with the aid of the holder device 9, so as to enable the spring unit 4 to be removed. The aforedescribed installation procedure is repeated after inserting the additional cable(s).

It will be understood that the invention is not restricted to the aforedescribed and illustrated exemplifying embodiment thereof and that modifications can be made within the scope of the following claims.

What is claimed is:

1. An earthing device for earthing a shielded cable for protection against high frequency electromagnetic interference comprising:

a rectangular metal collar in electrical contact with equipment to which or from which the shielded cable runs, wherein the collar includes pair-forming openings in each of two mutually opposing sides of the collar;

an electrically conductive base plate in contact with the collar and an exposed shield of the cable, wherein the base plate has pairs of outwardly projecting fingers for insertion in some of the pair-forming openings; and a spring unit comprising a pressure plate, a spring, a locking plate having pairs of projecting fingers, a counter-pressure plate, and a holder device;

wherein the locking plate's projecting fingers facilitate inserting the spring unit in the pair-forming openings at a distance from the base plate; the spring, prior to installation of the cable, is held in a substantially compressed state between the pressure plate and the counter-pressure plate with the aid of the holder device; and after installation, the holder device is loosened so that the spring extends and applies a constant pressure on the cable installed between the base plate and the pressure plate.

2. The earthing device of claim 6, wherein outer parts of the base plate's projecting fingers and of the locking plate's projecting fingers are folded at right angles for gripping outer surfaces of the collar to prevent the collar from flexing outwards when filled with cables.

3. The earthing device of claim 6, further comprising a thin cover plate fitted onto the base plate for covering a space between the base plate's projecting fingers and an inside of the collar to prevent cables from being pressed out therebetween.

4. The earthing device of claim 1, wherein the pressure plate has contact strips for pressing against an installed cable.

5. The earthing device of claim 1, wherein the pressure plate has a central, screw-threaded rod extending through the spring, the locking plate, and the counter-pressure plate; and the holder device is a nut threaded onto the rod.

* * * * *